US005236762A

United States Patent [19]

Suzuki et al.

[11] Patent Number: 5,236,762

[45] Date of Patent: Aug. 17, 1993

[54] ABRASIVE FILM AND METHOD FOR PRODUCTION THEREOF

[75] Inventors: Yasuyuki Suzuki; Hiromi Masamura; Hikaru Honjo, all of Saitama, Japan

[73] Assignee: Somar Corporation, Tokyo, Japan

[21] Appl. No.: 620,120

[22] Filed: Nov. 30, 1990

[30] Foreign Application Priority Data

Jan. 22, 1990 [JP] Japan ..... 2-10568

[51] Int. Cl.[5] ..... D06N 7/04; B32B 5/16

[52] U.S. Cl. ..... 428/141; 428/143; 428/148; 428/149; 428/206; 428/325; 428/328; 428/329; 428/331; 428/337; 428/402; 428/698; 428/702

[58] Field of Search ..... 428/141, 195, 201, 206, 428/325, 329, 331, 328, 337, 698, 523, 532, 702, 908.8, 142, 143, 148, 149, 339, 402, 409, 212

[56] References Cited

U.S. PATENT DOCUMENTS 4,540,618 9/1985 Suzuki et al. ..... 428/141

FOREIGN PATENT DOCUMENTS 0278703 8/1988 European Pat. Off. .
1295562 4/1961 France .
969535 9/1964 United Kingdom .

OTHER PUBLICATIONS

Patent Abstracts of Japan vol. 12, No. 113, (M-683)(2960) Apr. 9, 1988.

JP-A-62 241,671 (Fuji Photo Film Co. Ltd.) Oct. 22, 1987 *abstract*.

Patent Abstracts of Japan vol. 13, No. 25 (M-787)(3373) Jan. 20, 1989.

JP-A-63 237,872 (Ube Ind Ltd) Oct. 4, 1988 *abstract*.

Patent Abstracts of Japan vol. 12, No. 186 (C-500)(3033) May 31, 1988.

JP-A-62 290,372 (Sumitomo Chem Co Ltd) Dec. 17, 1987 *abstract*.

*Primary Examiner*—Donald J. Loney

*Attorney, Agent, or Firm*—Sughrue, Mion, Zinn, Macpeak & Seas

[57] ABSTRACT

An abrasive film is disclosed, which comprises a film substrate having an abrasive layer on at least one side thereof, wherein said abrasive layer comprises abradant particles uniformly dispersed in at least one binder selected from water-soluble macromolecular substances and water-dispersible macromolecular substances, and a method for the production thereof is disclosed, which comprises: applying to at least one side of a film substrate a coating liquid, which is prepared by dispersing the abradant into an aqueous medium containing at least one binder selected from water-soluble macromolecular substances and water-dispersible macromolecular substances; or prepared by mixing the abradant and at least one binder selected from water-soluble macromolecular substances and water-dispersible macromolecular substances with an aqueous medium, and then drying the coated abrasive layer by heating.

10 Claims, No Drawings

ABRASIVE FILM AND METHOD FOR PRODUCTION THEREOF

FIELD OF THE INVENTION

This invention relates to an abrasive film suitable for use in the precise abrasive finishing of magnetic heads, magnetic disks, micrometers, watches, molds, various OA (office automation) apparatus, and other articles and materials.

BACKGROUND OF THE INVENTION

Previously, most abrasive films have been prepared by using a coating liquid with abrasive grains made out of an inorganic substance micro-powder dispersed in an organic solvent binder, coating the coating liquid on a film-like substrate, and then drying the film by heating, as described, for example, in JP-B-53-44714 (the term "JP-B" as used herein means an "examined Japanese patent publication"). However, because the film prepared by this method results in insufficient wetting of the abrasive grain binder solution, abrasive grain-dispersing stability is lowered. Accordingly, a high quality coating layer cannot be obtained due to coagulation. Further, because of poor storability of the coating liquid, it is necessary to apply a complicated operation such as mixing during coating which sometimes results in difficulties.

Moreover, since solvents for the coating liquid such as toluene, xylene, ethyl acetate, and methylethyl ketone are used in the above method, safety, non-pollution and resource conservation are important considerations.

SUMMARY OF THE INVENTION

The present invention provides a high quality abrasive film and a method for producing the same, that has abrasive grain dispersing stability and can be produced safely.

As a result of research, the present inventors have found that by applying to at least one side of a film substrate a liquid, which is prepared by dispersing the abradant into an aqueous medium containing at least one binder selected from water-soluble and water-dispersible macromolecular substances; or is prepared by mixing the abradant and the binder with an aqueous medium, it is possible to stably disperse abrasive grains in a binder-containing liquid.

The object of the present invention is to provide an improved abrasive film having abrasive grain dispersing stability and high quality. The above and other objects and advantages are attained by an abrasive film comprising a film substrate having an abrasive layer on at least one side thereof, wherein said abrasive layer comprises abradant particles uniformly dispersed in at least one binder selected from water-soluble macromolecular substances and water-dispersible macromolecular substances.

In addition, the present invention provides a method for producing the above abrasive film which will be described in greater detail below.

DETAILED DESCRIPTION ON THE INVENTION

The abradant particles which can be used herein are not specifically limited, but inorganic fine powders having a high degree of hardness are preferable. These include, for example, alumina, silicon carbide, chromium oxides, diamond, iron oxides, silicon nitride, zirconia, borosilicate, and emery.

The binders which can be used herein may be those that are usually employed in conventional abrasive films, such as, water-soluble macromolecular binders and water-dispersible macromolecular binders.

Examples of water-soluble macromolecular binders include those from natural sources such as polysaccharide binders represented by starches, cellulose, tannin, lignin, alginic acid, and gum arabic, and gelatins; various resins such as vinyl acetate, ethylene oxide, acrylic, acrylamide, maleic anhydride, and phthalic acid resins; and those from synthetic sources such as water-soluble polyesters and water-soluble polyamines.

Examples of water-dispersible macromolecular binders include those from natural sources such as natural rubbers and latex; those from synthetic rubbers such as SBR (Styrene-Butadiene Rubber), NBR (Nitrile-Butadiene Rubber), and CR (Chloroprene Rubber); and those from synthetic sources such as vinylic resin (e.g., acrylic resins, vinyl acetate resins, and vinyl chloride resins), and urethane resins, epoxy resins, and olefinic resins (e.g., polyethylene).

The substrate films which can be used herein are not specifically restricted. Specifically, films that are comprised of resins excellent in mechanical strength, dimensional resistance, heat resistance, and other properties are preferred. Examples of such resins include polyethylene terephthalate, stretched polyethylene, diacetate acetate, triacetate acetate, and polycarbonate.

If the substrate film resin has poor adherability to the above-mentioned water-soluble macromolecular binder or water-dispersible macromolecular binder, like polypropylene, it is preferable to apply surface-treatment for easy adherence. Examples of such surface-treatments include chemical procedures such as washing and drying after the treatment with a concentrated sulfuric acid-potassium bichromate mixed liquid; electric procedures such as corona discharge treatment and the CASING method (Bell Telephone Corp.); as well as flame treatment procedures, for example, by means of a Bunsen burner.

The substrate film, used in the present invention, is 25–125 microns in thickness, preferably 25–75 microns in thickness.

In the abrasive film of the present invention, the abradant particles are selected so that the particle diameter is within the range of 0.3–60 microns, preferably 1.0–16 microns. The amount of the binder used is generally in the range of 15 to 100 wt %, preferably 20–50 wt %, relative to the total amount of the abradant particles.

The abrasive film of the present invention is produced by applying to either side or both sides of a film substrate a coating liquid, which is prepared by dispersing the abradant into an aqueous medium containing at least one binder selected from water-soluble macromolecular substances and water-dispersible macromolecular substances; or prepared by mixing the abradant and the binder with an aqueous medium, and then drying the coated abrasive layer by heating (e.g., at 100° to 150° C. for 30 sec. to 2 min.). The heating step causes the abrasive layer to be integrally laminated with the substrate. Further, the abradant particles are integrated with the binder.

It is also possible that a three-dimensional crosslinked structure may be formed at the same time by a crosslinking agent that has been preformulated in the preparation coating liquid described above. Examples of suitable crosslinking agents include, for example, an aqueous melamine resin, an isocyanate compound and an aziridine compound.

As desired, conventional additives for this type of binder composition may include wetting agents, defoaming agents, particle size regulators, colorants, catalysts for curing, and stabilizers.

Generally, water may be used as the sole aqueous solvent described above. Depending on the type and preparation of binder to be used, end-use of the abrasive film, and the like, hydrophilic solvents and polar solvents such as alcohols, ethers, ketones, esters may be used together as needed.

The preparation coating liquid described above generally has a viscosity ranging from 10–100,000 cps, preferably 100–10,000 cps.

The method of applying the coating preparation to the substrate is not specifically limited. Either a coating method, which coats the preparation, or an impregnation method is generally used. Paticularly advantageous is a coating method such as a bar coating method, a knife coating method, a roll coating method, a rod coating method, a gravure coating method, a comma coating method, a kiss coating method, or a spray coating method.

The coating method is not specifically limited. Any suitable method can be selected by one of ordinary skill in the art, taking into consideration the coating amount, physical properties of the coating liquid such as solid content and viscosity.

In the abrasive film of the present invention, the abrasive particles are uniformly dispersed in the coating layer; the surface has decreased roughness; it has good adhering property to an article during the course of abrading; and it is free of any uneven portion due to coagulation. The abrasive film provides a good finished surface due to the decrease in roughness of the surface of the articles. Further, because of a large amount of abrading, abrasive operation can be finished in a short amount of time. Furthermore, since little or no organic solvent is used, the abrasive film of this invention also exhibits significant effects with respect to safety, preventing enviromental pollution, and conserving resources.

As a result, the abrasive film of the present invention is suitable for use in the precise abrasive finishing of magnetic heads, magnetic disks, micrometers, watches, molds, various OA (office automation) apparatus, and other articles and materials.

The invention will be described in detail with reference to the following non-limiting example.

EXAMPLE

| Components | Parts by weight |
|---|---|
| Aluminum oxide #2000 average particle size 8 microns (from Showa Denko K.K. under tradename of White Morundum WA-2000) | 30.0 |
| Aqueous emulsion of self-crosslinking acrylic resin (from Hoechst Synthetic Corp. under tradename of Mowinyl 747, 43% solid content) | 16.3 |
| Water-soluble melamine (crosslinking agent) (from Sumitomo Chemical Co., Ltd. under trademark of Sumitex resin M-3, 80% solid content) | 3.7 |
| Aqueous 20% $NH_4Cl$ solution (catalyst) | 0.8 |
| Aqueous 5% ammonia solution (pH regulator) | 3.5 |

-continued

| Components | Parts by weight |
|---|---|
| Non-ionic surfactant (wetting agent) | 0.5 |
| Mineral oil formulation (defoaming agent) | 0.1 |
| Water-soluble polyacrylic acid (viscosity regulator) (Nippon Junyaku Corp. under tradename of Jurymer AC-10H) | 3.0 |
| Water | 42.1 |

One side of a polyethylene film, 75 microns in thickness, which had been treated for easy aherence (available from DIAFOIL Co., Ltd. and marketed by the tradename of "T100 EW-08"), was coated with a dispersed mixed liquid of abrasive particles comprising the above-mentioned composition by means of a bar coating method. Heating at 130° C. for 2 minutes was carried out to dry and crosslink the obtained material. Then an abrasive film with an abrasive layer measuring 12 microns in thickness coated thereon was obtained.

The preparation of the coating liquid was carried out by mixing seven components of the above-mentioned composition except for the aqueous emulsion of self-crosslinking acrylic resin and the defoaming agent, dispersing the mixture in a homogenizer at 8,000 rpm for 60 minutes, adding the remaining two components to the resulting liquid, thoroughly mixing by a blade mixer, and then deaerating the resulting liquid in vacuo while stirring.

COMPARATIVE EXAMPLE

| Components | Parts by weight |
|---|---|
| Aluminum oxide #2000 average particle size 8 microns (from Showa Denko K.K. under tradename of White Morundum WA-2000) | 30 |
| Saturated polyester resin (from Unitika Ltd. under tradename of UE3220) | 10 |
| Toluene | 48 |
| Methylethyl ketone | 12 |

For comparison, one side of a polyethylene film, 75 microns in thickness, was coated with a dispersed mixed liquid of abrasive particles comprising the above mentioned composition by means of a bar coating method. It was then thermally treated at 130° C. for 2 minutes to provide an abrasive film with an abrasive layer measuring 12 microns in thickness coated thereon.

The arithmetic average roughness (Ra) of the abrasive film produced in the Example and Comparative Example was measured. The film was finely cut to 25.4 mm in width, the strips were loaded at 500 g on the surface of SK-tool steel, which rotated at the rate of 500 rpm to abrade its cylindrical surface for 7 minutes, while being fed at the rate of 30 mm/min. The size of tool steel was 10×80 mm. The abrading amount was obtained from the weight decrease of the test piece. The results are shown in the table below.

The arithmetic average roughness of the abrasive film was measured according to JIS (Japanese Industrial Standard) B0601 by the use of TR-100X from Kosaka Research Laboratory as a surface roughness meter. In this case, the cut-off value was 0.25 mm, and the measurement length was 4 mm.

TABLE

| Film | Arithmetic Average-Roughness (Ra) of Film (micron) | Abrading Amount (mg) | Roughness of Finished Surface (micron) |
|---|---|---|---|
| Example | 1.59 | 3.9 | 0.030 |
| Comp. Example | 2.82 | 1.6 | 0.070 |

While the invention has been described in detail and with reference to specific embodiments thereof, it will be apparent to one skilled in the art that various changes and modifications can be made therein without departing from the spirit and scope thereof.

We claim:

1. An abrasive film comprising a film substrate having an abrasive layer on at least one side thereof, wherein said abrasive layer comprises abradant particles uniformly dispersed in at least one binder selected from the group consisting of water-soluble macromolecular substances and water-dispersible macromolecular substances, wherein the amount of binder present is from 15 to 100 weight % relative to the total amount of the abradant particles.

2. The abrasive film as in claim 1, wherein the binder is a water-soluble macromolecular substance.

3. The abrasive film as in claim 1, wherein the binder is a water-dispersible macromolecular substance.

4. The abrasive film as in claim 1, wherein the abradants are selected from the group consisting of alumina, silicon carbide, chromium oxides, diamond, iron oxides, silicon nitride, zirconia, borosilicate and emery.

5. The abrasive film as in claim 1, wherein the substrate film is selected from the group consisting of polyethylene terephthalate, stretched polyethylene, diacetate acetate, triacetate acetate and polycarbonate.

6. The abrasive film as in claim 1, wherein the substrate film is 25–125 microns in thickness.

7. The abrasive film as in claim 6, wherein the substrate film is 25–75 microns in thickness.

8. The abrasive film as in claim 1, wherein the abradant particles are 0.3–60 microns in diameter.

9. The abrasive film as in claim 8, wherein the abradant particles are 1.0–16 microns in diameter.

10. The abrasive film as in claim 1, wherein the amount of binder present is from 20 to 50 weight % relative to the total amount of the abradant particles.

* * * * *